US007832810B2

(12) United States Patent
Boucherie

(10) Patent No.: US 7,832,810 B2
(45) Date of Patent: Nov. 16, 2010

(54) STUFFING MACHINE FOR BROOMS OR BRUSHES

(75) Inventor: Bart Gerard Boucherie, Izegem (BE)

(73) Assignee: Firma G.B. Boucherie N.V., Izegemi (BE)

( * ) Notice: Subject to any disclaimer, the term of this patent is extended or adjusted under 35 U.S.C. 154(b) by 921 days.

(21) Appl. No.: 11/645,487

(22) Filed: Dec. 26, 2006

(65) Prior Publication Data

US 2007/0152496 A1 Jul. 5, 2007

(30) Foreign Application Priority Data

Jan. 4, 2006 (DE) ..... 20 2006 000 076 U

(51) Int. Cl.
*A46D 3/04* (2006.01)

(52) U.S. Cl. ..... 300/2; 300/4; 300/5

(58) Field of Classification Search ..... 300/2, 300/4–5, 7–10, 21
See application file for complete search history.

(56) References Cited

U.S. PATENT DOCUMENTS

| | | | | |
|---|---|---|---|---|
| 1,941,343 | A * | 12/1933 | Epp | 300/2 |
| 1,963,045 | A * | 6/1934 | Frederic | 300/2 |
| 2,211,036 | A | 8/1940 | Vinal | |
| 2,611,652 | A * | 9/1952 | Ruben | 300/21 |
| 3,450,312 | A | 6/1969 | Boucherie | |
| 4,609,228 | A * | 9/1986 | Bickel | 300/4 |
| 6,786,558 | B2 * | 9/2004 | Driesen et al. | 300/21 |

FOREIGN PATENT DOCUMENTS

| | | |
|---|---|---|
| DE | 815 795 | 10/1951 |
| EP | 0 795 285 | 9/1997 |

* cited by examiner

*Primary Examiner*—Laura C Guidotti
(74) *Attorney, Agent, or Firm*—Stuart J. Friedman

(57) ABSTRACT

A bristle magazine for a broom or brush stuffing machine includes a receiving space for a multitude of bristles, a bending edge and a bracket opposite the bending edge for maintaining the bristles in a curved condition.

16 Claims, 5 Drawing Sheets

STUFFING MACHINE FOR BROOMS OR BRUSHES

BACKGROUND OF THE INVENTION

1. Field of the Invention

This invention relates to a stuffing machine for a broom or brush, said stuffing machine including a bristle magazine comprising a receiving space for a multitude of bristles.

2. Description of Related Art

In conventional stuffing machines for brooms or brushes, the bristles usually are disposed upright in the bristle magazine. On one side of the bristle magazine, an outlet opening is provided, on which a bristle transfer device is disposed. The same removes a bundle of bristles from the bristle magazine and transports the bundle to a stuffing device, which then inserts the bundle into the broom or brush body.

Short bristles, as they are used for instance for tooth brushes and certain household brushes, can easily be accommodated upright in a bristle magazine. Their inherent rigidity is large enough, so that the bristles substantially extend linearly; the bristles do not bend, or are only bent to a minor extent, and they do not become entangled with adjacent bristles. In the case of longer and/or thinner bristles, as they are used in particular for certain brooms, e.g. so-called Italian brooms, the inherent rigidity of the bristles is not sufficient to ensure that the bristles in the bristle magazine remain vertically upright on their own. In particular in their upper half, the bristles tend to come to lie before and behind adjacent bristles. This is a problem when a bundle of bristles should be removed, of which some bristles still are entangled with other bristles standing further to the rear in the bristle magazine.

BRIEF SUMMARY OF THE INVENTION

The object underlying the invention is to create a bristle magazine which prevents the bristles from becoming entangled with each other.

For the solution of this object, a bending edge and a bracket opposite thereto are provided in accordance with the invention, so that the bristles can be maintained in a curved condition. The invention is based on the knowledge that the bristles need not necessarily be maintained in the bristle magazine completely straight, but that they can in part deliberately be folded down. This prevents the individual bristles from becoming entangled with each other. The folded part of a bristle loosely lies on top of the folded parts of the other bristles, the sequence of the bristles always being maintained. A positive side effect of this type of arrangement of the bristles consists in that the height of the bristle magazine is reduced. Thus, a plurality of bristle magazines can be disposed closely one beside the other.

In accordance with one concept it is provided that only the upper half of the bristles is folded down, whereas the lower half is accommodated vertically. This concept takes into account that the risk of the bristles becoming entangled is greatest in their upper half; the lower half still can be accommodated vertically.

In accordance with a second concept it is provided that the bristles are clamped or guided in their middle portion and both the upper and the lower half is folded down. The bristles then have a generally V-shaped or U-shaped configuration. In the case of the second concept, a particularly small height of the bristle magazine is obtained.

Advantageous aspects of the invention can be taken from the sub-claims.

BRIEF DESCRIPTION OF THE DRAWINGS

The invention will subsequently be described with reference to various embodiments which are illustrated in the accompanying drawings, in which.

DETAILED DESCRIPTION OF THE INVENTION

Figure 1:
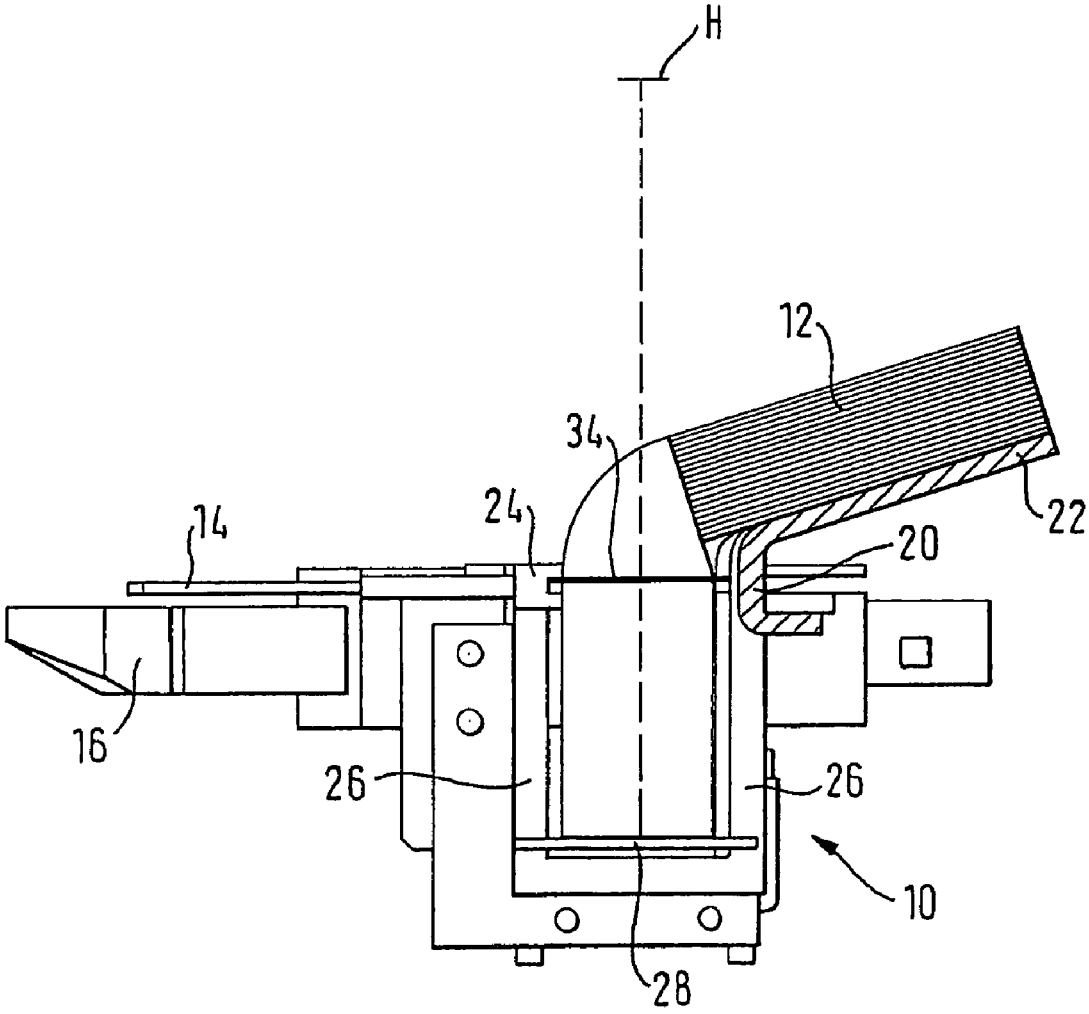
FIG. 1 shows a schematic section of a bristle magazine in accordance with a first embodiment.

FIG. 1 schematically shows a bristle magazine 10 in which bristles 12 are accommodated, which can be supplied to a stuffing tool 16 by means of a bundle transfer device 14. The bristle magazine 10 has a bending edge 20, which here constitutes a rail. A supporting plate 22 is associated to the rail 20. Opposite the bending edge 20 a bracket 24 is disposed, which likewise constitutes a rail. Below the bending edge 20 and the bracket 24, two side walls 26 and a base 28 are disposed, which together form a receiving box. Between the bending edge 20 and the bracket 24 a major stock of bristles 12 is retained. The height of the receiving box formed by the side walls 26 and the base 28 is dimensioned such that approximately the middle of the bristles lies between the bending edge 20 and the bracket 24. The lower half of the bristles thus is located vertically in the receiving box and can stand on the base 28. The upper half of the bristles is bent by about 70° with respect to a vertical orientation, so that it rests on the supporting plate 22.

Folding down the upper half of the bristles has the following advantages: On the one hand, a very much smaller height of the bristle magazine is obtained. In FIG. 1, H designates the height the bristles 12 would achieve, if they were accommodated linearly upright in the bristle magazine. A second advantage consists in that the upper half of the bristles no longer tends to become entangled with each other, as the bristles loosely rest on the supporting plate 22 and are all folded down in the same direction; in the linearly upright condition, the upper half of the bristles would tend to lay down on its own, chaotically to the front, to the rear or to the side, whereby the bristles can easily become entangled with bristles lying before or behind the same.

Figure 2:
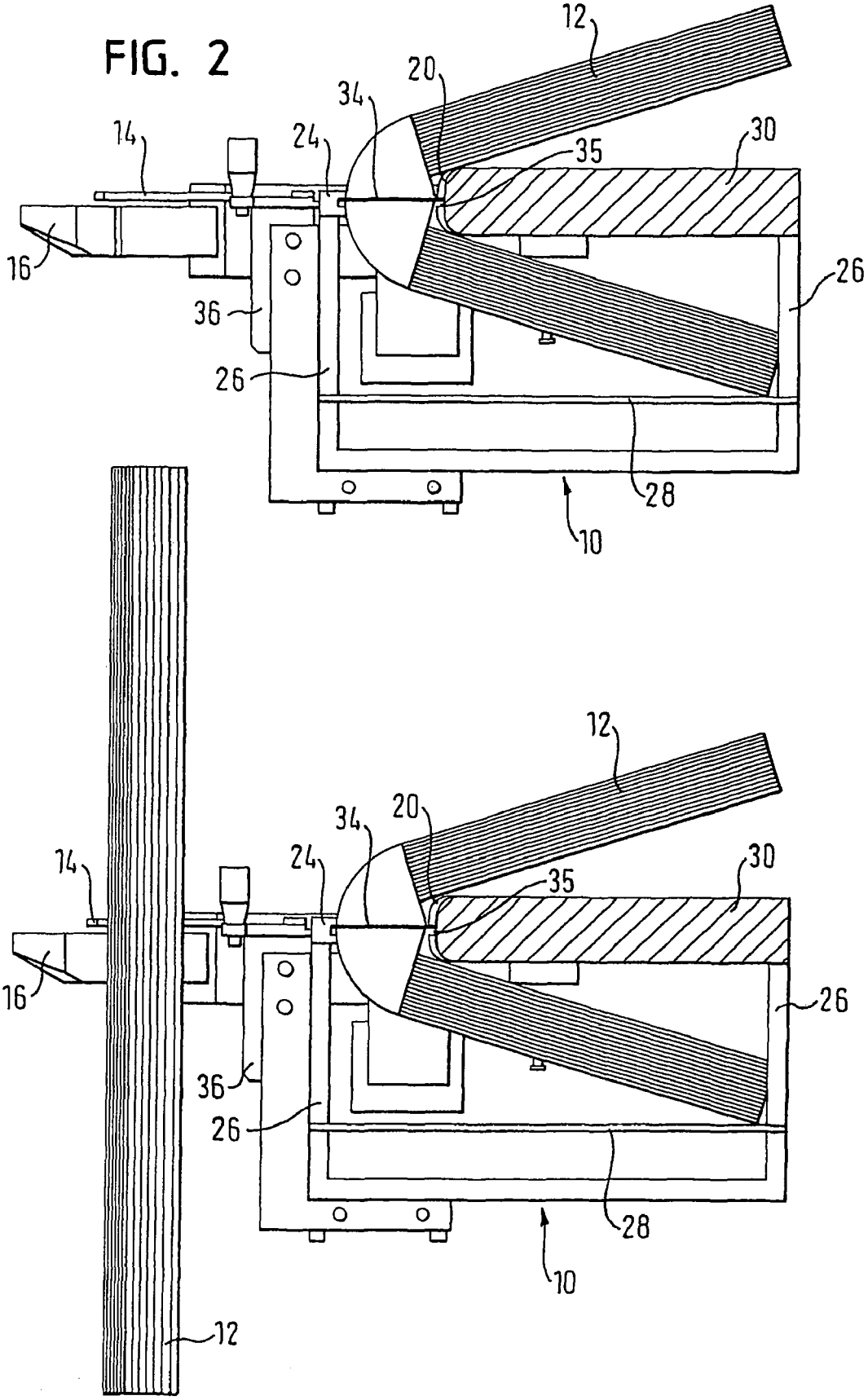
FIG. 2 shows a schematic sectional view of a bristle magazine in accordance with a second embodiment.
Figure 3:
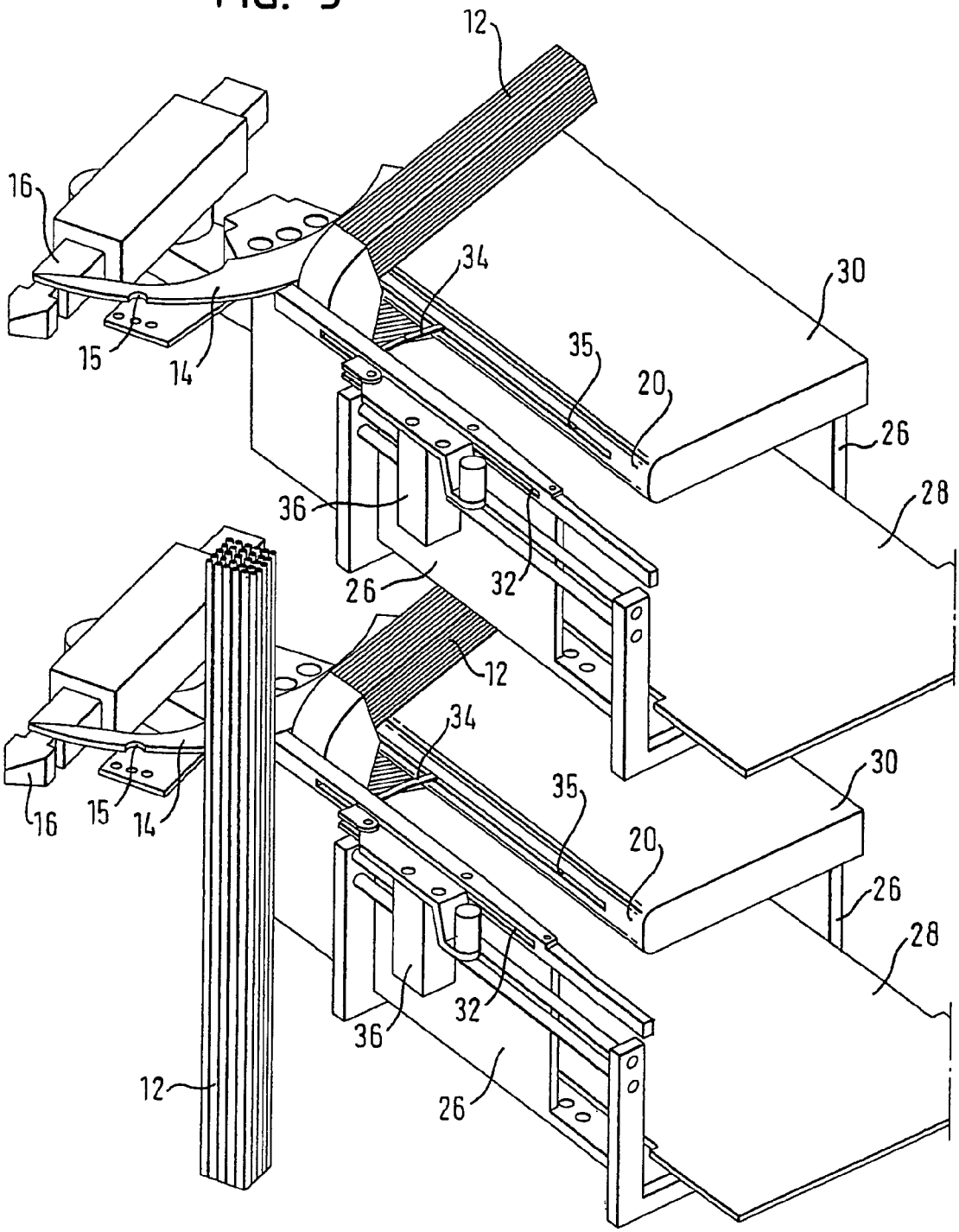
FIG. 3 shows a perspective view of the bristle magazine of FIG. 2.

In FIGS. 2 and 3, a second embodiment is shown. For the components known from the first embodiment, the same reference numerals are used, and in so far reference is made to the above explanations.

The essential difference between the first and the second embodiment consists in that in the second embodiment not only the upper half of the bristles 12 is folded down, but also the lower half. The base 28 is disposed at such a small distance from the bending edge 20 and the bracket 24 that the lower half is folded down symmetrically with respect to the upper half of the bristles, so that the bristles generally have a V-shaped or U-shaped configuration. Another difference of the second embodiment from the first embodiment consists in that two bristle magazines 10 are disposed one on top of the other. The two bristle magazines can be disposed very much closer to each other than is possible in the prior art. This is particularly obvious when the extended length of the bristles is observed, which is likewise illustrated in FIGS. 2 and 3 for comparison. However, two bristle magazines can of course also be disposed one on top of the other in accordance with the first embodiment.

For separation between the lower receiving space, which is formed by the two side walls 26 and the base 28, and the upper receiving space, which is located above the bending edge 20 and the bracket 24, a plate 30 is provided in the second embodiment, which can be regarded as a cover of the lower receiving space. The bending edge 20 constitutes a rounded end face of this plate 30.

The bracket 24 is provided with a slot 32, through which a feed element 34 (also known as "pressing element" or "material depresser") can extend. The feed element 34 extends from the bracket 24 towards the bending edge 20, a groove 35 being provided in the end face of the plate 30, in which the tip of the feed element 34 is immersed, so that no bristles can become clamped between the feed element 34 and the bending edge 20. The feed element 34 is adjusted by an external driving device 36 such that the stock of bristles 12 in the bristle magazine always is under the desired pressure.

FIG. 3 also very clearly shows the bundle transfer device 14 (referred to as "bundle remover" or "circular arc") and the stuffing tool 16. In a reciprocating swivel movement between the bristle magazine 10 and the stuffing tool 16, the bundle transfer device 14 is adjusted such that a bundle receiving notch 15 formed on the same is swivelled in front of an outlet opening of the bristle magazine 10, where it takes a bundle of bristles 12. Subsequently, the bundle transfer device 14 is swivelled such that the bundle receiving notch 15 lies in front of the stuffing tool 16, which inserts the offered bundle of bristles 12 into the brush or broom body.

Figure 4:
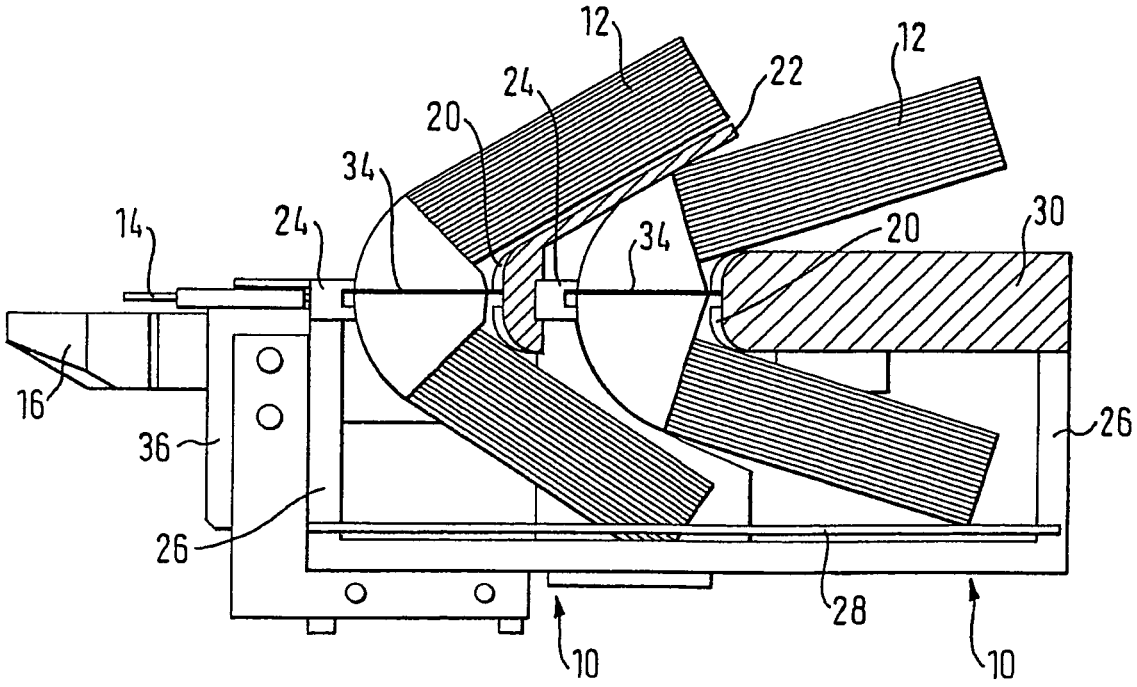
FIG. 4 shows a schematic sectional view of a bristle magazine in accordance with a third embodiment.

In FIG. 4, another embodiment is shown. For components known from the preceding embodiments the same reference numerals are used, and in so far reference is made to the above explanations.

The embodiment shown in FIG. 4 differs from the preceding embodiments in that two bristle magazines are provided nested in each other, the apex of the curved bristles of one bristle magazine being arranged in the space between the bent legs of the bristles of the second bristle magazine. In the case of the bristles 12 shown on the right in FIG. 4, the plate 30 is used for the separation between the upper half and the lower half of the bristles 12, on the end face of which plate the bending edge 20 is formed. For the bristles of the second bristle magazine arranged to the left thereof, a rail is used as bending edge 20, which is disposed directly adjacent to the bracket 24 of the first bristle magazine. The supporting plate 22 is associated to the rail. Said supporting plate cannot only be used for supporting the upper half of the bristles 12 of the second, left-hand bristle magazine 10, but also as a depresser for the upper half of the bristles of the first, right-hand bristle magazine. With the illustrated arrangement of the curved bristles 12, different kinds of bristles can be accommodated in a particularly compact way and be supplied to the stuffing tool 16.

Figure 5:
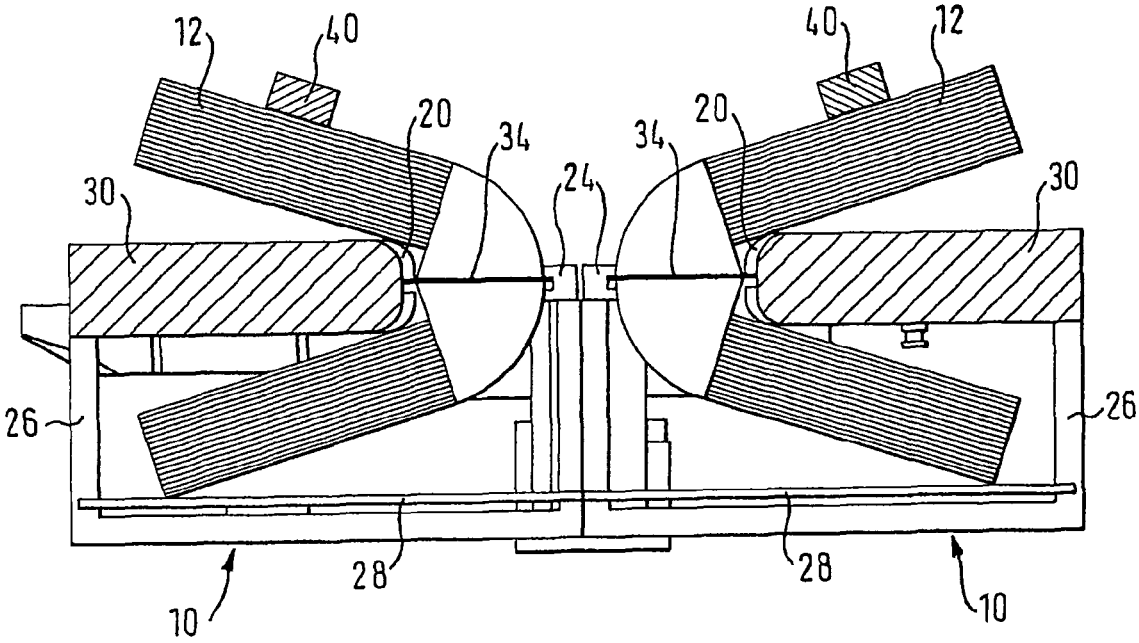
FIG. 5 shows a schematic sectional view of a bristle magazine in accordance with a fourth embodiment.

In FIG. 5, another embodiment with two bristle magazines 10 is shown. For the components known from the preceding embodiments, the same reference numerals are used, and in so far reference is made to the above explanations.

The difference between the embodiment shown in FIG. 4 and the embodiment shown in FIG. 5 consists in that in the embodiment shown in FIG. 5 the curved bristles 12 are arranged such that their apexes are disposed opposite each other. In other words, the two brackets 24 are disposed back to back directly adjacent each other. In order to maintain the upper half of the bristles 12 in the folded, bent condition, a holding rail 40 is each provided, which approximately has the same function as the base 28; it is ensured that the upper half of the bristles is guided around the bending edge 20 and is then maintained in a condition folded down flat.

The holding rail shown in FIG. 5 can also be used in the same way in the embodiments of FIGS. 1 to 4, in order to maintain the upper half of the bristles in a certain position.

The invention claimed is:

1. A stuffing machine for brooms or brushes, the stuffing machine having a stuffing tool, a bundle transfer device and a bristle magazine for storing and holding bristles prior to their transfer by said bundle transfer device, said bundle transfer device being adapted for taking a bundle of bristles from said bristle magazine and transferring it towards said stuffing tool such that said bundle of bristles is offered to said stuffing tool for insertion of said bundle by said stuffing tool into a broom or brush body, said bristle magazine including a receiving space for a multitude of bristles, a first bending edge and a first bracket opposite the first bending edge for bending and maintaining the bristles in a curved condition while in said bristle magazine.

2. The stuffing machine as claimed in claim 1, wherein the first bending edge is formed by a rail.

3. The stuffing machine as claimed in claim 1, wherein said bristles are elongate and a portion of the length of said bristles is bent around said bending edge, said bristle magazine further includes a supporting plate for supporting the bent portion of said bristles.

4. The stuffing machine as claimed in claim 3, wherein the supporting plate is formed integrally with the first bending edge.

5. The stuffing machine as claimed in claim 1, wherein the first bending edge is formed by a rounded end face of a plate.

6. The stuffing machine as claimed in claim 1, wherein the first bracket is a rail.

7. The stuffing machine as claimed in claim 1, further including a holding rail for maintaining the bristles in a curved condition.

8. The stuffing machine as claimed in claim 1, wherein said bristle magazine further includes a receiving box for about one half of the bristles adjoining the first bending edge.

9. The stuffing machine as claimed in claim 8, wherein the receiving box includes a base on which one of the ends of the bristles can rest, whereby the bristles are maintained in a curved condition.

10. The stuffing machine as claimed in claim 9 wherein said base is positioned at a sufficiently small distance from said bending edge that the about one half of said bristles within said receiving box are caused to bend about said bending edge, whereby said bristles define a generally V-shaped or U-shaped configuration.

11. The stuffing machine as claimed in claim 10 wherein the distance of said base from said bending edge is selected such that said about one half of said bristles within said receiving box are bent symmetrically with respect to the other about one half of said bristles.

12. The stuffing machine as claimed in claim 1, wherein the first bracket includes a slot through which a feed element can extend.

13. The stuffing machine as claimed in claim 10, wherein the first bending edge includes a groove into which a feed element can penetrate.

14. The stuffing machine as claimed in claim 1, further including a second bending edge adjacent the first bracket and a second bracket opposite said second bending edge.

15. The stuffing machine as claimed in claim 1, further including a second bristle magazine directly above the bristle magazine.

16. The stuffing machine as claimed in claim 1, further including a second bracket adjacent the first bracket and a second bending edge opposite said second bracket.

* * * * *

UNITED STATES PATENT AND TRADEMARK OFFICE

CERTIFICATE OF CORRECTION

PATENT NO. : 7,832,810 B2
APPLICATION NO. : 11/645487
DATED : November 16, 2010
INVENTOR(S) : Bart Gerard Boucherie It is certified that error appears in the above-identified patent and that said Letters Patent is hereby corrected as shown below:

Title Page, item (73), Assignee: should read "Izegem".

Signed and Sealed this
Twenty-fifth Day of January, 2011

David J. Kappos

David J. Kappos
*Director of the United States Patent and Trademark Office*